US009609950B2

(12) United States Patent
Covelli

(10) Patent No.: US 9,609,950 B2
(45) Date of Patent: Apr. 4, 2017

(54) ACTIVE SEATING CUSHION

(71) Applicant: Fabrice Covelli, Brooklyn, NY (US)

(72) Inventor: Fabrice Covelli, Brooklyn, NY (US)

( * ) Notice: Subject to any disclaimer, the term of this patent is extended or adjusted under 35 U.S.C. 154(b) by 0 days.

(21) Appl. No.: 15/060,407

(22) Filed: Mar. 3, 2016

(65) Prior Publication Data

US 2016/0174716 A1 Jun. 23, 2016

Related U.S. Application Data

(63) Continuation of application No. 14/522,012, filed on Oct. 23, 2014, now abandoned.

(51) Int. Cl.

| | |
|---|---|
| ***A47C 7/02*** | (2006.01) |
| ***A47C 7/14*** | (2006.01) |
| ***A47C 4/54*** | (2006.01) |

(52) U.S. Cl.

CPC ..... *A47C 7/021* (2013.01); *A47C 4/54* (2013.01); *A47C 7/022* (2013.01); *A47C 7/14* (2013.01)

(58) Field of Classification Search

CPC ..... A47C 7/021; A47C 7/022; A47C 27/081; A47C 7/14; A47C 4/54

USPC ..... 297/452.21, 452.22, 452.23, 452.24, 297/452.28, 452.55, 452.41, 199, 195.1, 297/DIG. 3; 5/654, 655.3

See application file for complete search history.

(56) References Cited

U.S. PATENT DOCUMENTS

| | | | | |
|---|---|---|---|---|
| 2,077,233 A * | 4/1937 | Greenhill | B60N 2/7082 | 267/117 |
| 2,366,680 A * | 1/1945 | Valentine | A47C 7/021 | 217/3 R |
| D240,173 S * | 6/1976 | Young | D6/331 | |
| 5,779,317 A * | 7/1998 | Neal | A47C 13/005 | 297/440.2 |

* cited by examiner

*Primary Examiner* — Milton Nelson, Jr.
(74) *Attorney, Agent, or Firm* — Howard Eichenblatt, Esq.

(57) ABSTRACT

Embodiments described herein provide a cushion with active seating capacity, the cushion having a sitting portion and a rigid material to maintain the sitting portion.

10 Claims, 8 Drawing Sheets

ACTIVE SEATING CUSHION

PRIORITY CLAIM

This application claims priority to U.S. application Ser. No. 14/522,012, filed Oct. 23, 2014. The above references application is incorporated herein by reference as if restated in full.

BACKGROUND

Active seating is an improvement upon traditional seating. In the latter, an individual "sits down", sometimes leaning against a backrest, sometimes not; such seating is detrimental not only to the spine and the back generally, but to the whole body as a result of sustained mechanical stress on muscle and tissue. Active seating is based on the seemingly paradoxical principle that a sitter should always be moving. The type of movement encouraged by active seating permits one to remain sitting while alternating weight from the left to the right, from the thighs to the buttocks, as well as in diagonal coordinates, thereby preventing the creation of sustained mechanical stress points. This encouragement can be accomplished by providing stimuli, such as the feeling of being off-balanced, whereupon the sitter will feel inclined to "rebalance", an action that requires subtle, but constant movement and good posture. Not only do these movements prevent the mechanical stress points, but they also strengthen the muscles, particularly in the core and back areas, and permit better circulation in the legs. While these extra movements may initially require conscious focus by the sitter, they gradually become instinctive.

SUMMARY

The present invention is a cushion with active seating capacity. While the sitting portion is substantially elastic, it permits some deformation through the act of sitting; however, this deformation will not render the cushion flat, nor will it negate the active seating nature of the cushion. This is accomplished by a less flexible center, which remains structurally resilient to deformation. The sitting portion is attached or otherwise adapted to a rigid surface, either directly or through an intermediary material. This rigid surface helps maintain the placement of the cushion, and prevents the bottom of the cushion from buckling.

DETAILED DESCRIPTION

In one embodiment, as seen in FIG. 3-6, the cushion 30 comprises a primary surface 10 and a base 20. The primary surface is meant to be more or less directly sat upon and is therefore yielding in nature, admitting some deformation to conform in part to the shape of the sitter's bottom. It is also foreseeable that the primary surface may support other parts of a person's body, such as their feet, calves, thighs, lower back, upper back, stomach, chest, neck, and/or head, and other embodiments may be shaped with those parts in mind.

The primary surface may be made of any elastic and substantially non-porous material, such as rubber, latex, polychloroprene, silicon, polyurethane, vinyl, or a nylon fabric. Additionally, the primary surface may be coated with a gel to decrease porosity below the natural level of the material. The primary surface may be manufactured using any suitable process, such as spin casting, rotocasting, etc. Spin casting operates by blasting semi-fluid material into the interior of a non-adhesive or decay-prone mold. When the semi-fluid material dries, solidifies, or cools, it takes the shape of the mold, and the mold is removed. The mold may be constructed to match the desired shape of the primary surface when it is ready for use, and so, the default shape of the primary surface is no different than its desired shape. The advantage is that if the primary surface is deflated, it will suck in air until the internal pressure matches atmospheric pressure, and consequently, less active inflation is necessary—only enough to increase the internal pressure above atmospheric pressure sufficiently to support the increased weight contributed by the sitter. Another advantage is that the primary surface can tolerate a low level of puncturing, since the rate at which air leaves a shape is proportional to the difference between the atmospheric pressure and the internal pressure.

Figure 4:
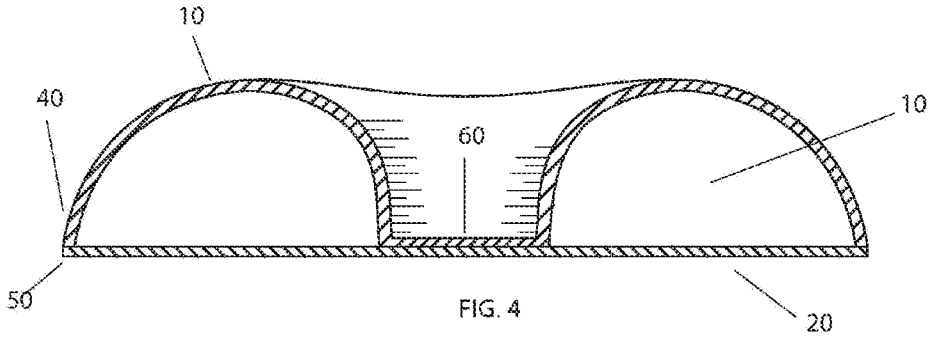
FIG. 4 is a cross-sectional side view of an exemplary cushion.

The base 20 is meant to secure in part the shape integrity of the primary surface 10. The base may be made of any material that substantially resists deformation, such as wood or hard plastic. In one embodiment, as seen in FIG. 4, the base 20 and primary surface 10 may be attached at their peripheries and at their centers, that is, the primary surface periphery 40 may be attached to the base periphery 50 and the primary surface center 6 may be attached to the base center 70, using any suitable means of attachment. The attachment means is preferably a sealant or any adhesive material that substantially prevents the flow of air or liquid through the space where the base and primary surface are attached. Alternatively, the periphery of the primary surface may be melted or molded to the periphery of the base. Examples of sealants include silicone, polyurethane, and fissures.

Figure 3:
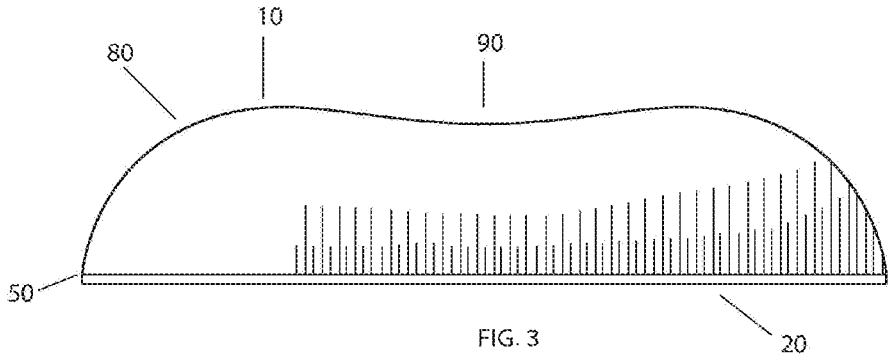
FIG. 3 is side view of an exemplary cushion.

In one embodiment, as seen in FIG. 3, the general shape of the primary surface 10 as seen from a side view is that of a complex curve, that curve having convex ends 80 and a concave center 90 between those two ends. This shape is substantially maintained on a plane three hundred and sixty degrees around that center, so that the shape as a whole may resemble a half sphere with a dip at what would otherwise be its most continuous area. This is a result of the primary surface center 60 being attached to the center 70 of the base 20, as seen in FIG. 4. Consequently, when a user sits or in any way leans a body part upon the primary surface 10, a force will press back against the user from the area around the concave center 90, but the concave center 90 will not, since no contact or little contact is made with the user.

The lack of contact or limited contact between the sitter and the concave center 90 also provides a more comfortable seating arrangement as compared to other active sitting arrangements, such as a gym ball/medicine ball; in the latter, the pressure exerted by the seat creates an oppressive sensation in a person's groin region, especially for sitters with hemorrhoids and other conditions.

While the primary surface 10 is elastic, at least when compared to the base 20, the concave center 90 at the center is somewhat less elastic due to the anchoring of the primary surface center 60 to the base center 70. Therefore, when a user's weight is applied to one side of the primary surface, such as the convex ends 80, the concave center 90 will not collapse, but will instead maintain the basic structure of the cushion. Since the user will not stabilize into the concave center 90, the user will be kept off balance until he or she intentionally rebalances using his or her muscles, distributing his or her weight to one and the other convex ends 80 of the primary surface 10 until the two convex ends are more or less balanced. In this way, the purpose of active seating is accomplished.

The space 100 between the base 20 and the primary surface 10 may contain a low density material such as virtually any gas or liquid. Alternatively, the space may contain higher density material such as viscous liquids or beads. It is also practical for the space to contain combinations of material. It is advantageous to use air due to its abundance and suitable qualities, but other materials may be useful for increasing the resistance to deformation of the primary surface shape. Also, air contains water vapor, which, in the event of temperature changes, may lead to the degradation of the material integrity of the cushion as well as its decompression.

Figure 5:
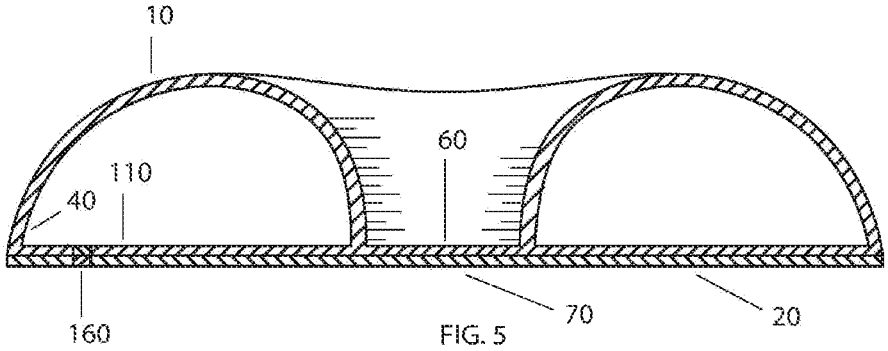
FIG. 5 is a cross-sectional side view of an exemplary cushion.

In one embodiment, as seen in FIG. 5, the primary surface 10 comprises a flush region 110. The flush region is attached to the primary surface periphery 40 and primary surface center 60, and sits flush against the top face of the base 20. In this embodiment, the base and/or the adapting region (to be discussed below), can be fixedly attached to a secondary surface by means of nails, screws, etc, and the primary surface can be attached afterward to the base, thereby eliminating the risk of puncturing the primary surface.

Figure 1:
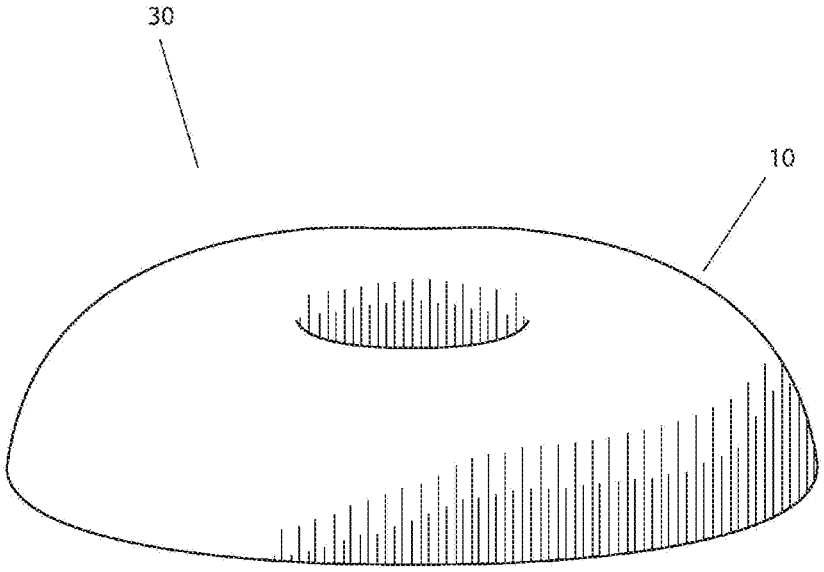
FIG. 1 is a perspective top view of an exemplary cushion.
Figure 2:
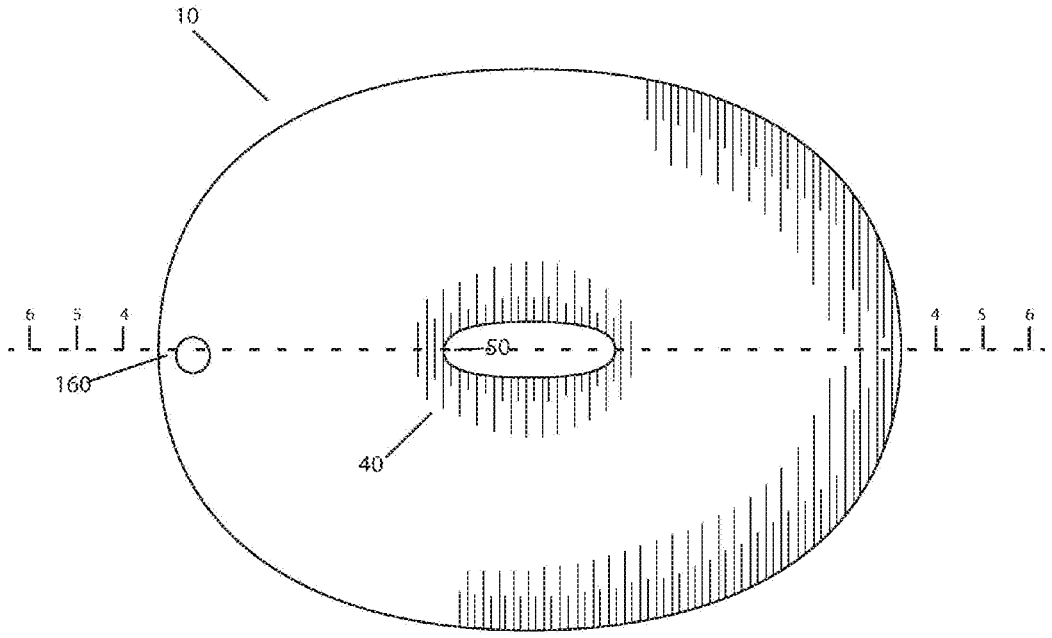
FIG. 2 is a top view of an exemplary cushion.
Figure 7:
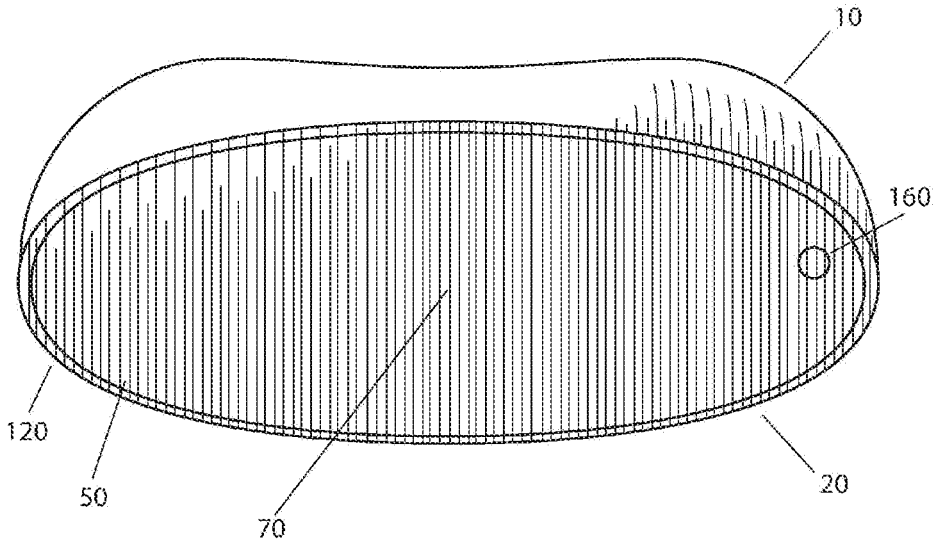
FIG. 7 is a perspective bottom view of an exemplary cushion.

In one embodiment, as seen in FIG. 3, when viewed from the side of the cushion, the base periphery 50 is visible. In another embodiment, as seen in FIG. 7 the primary surface comprises a lip 120, and the base periphery 50 is attached to the lip 120. In this embodiment, the base periphery 50 is concealed by the lip 120 when viewed from the side, as seen in FIG. 1.

Figure 6:
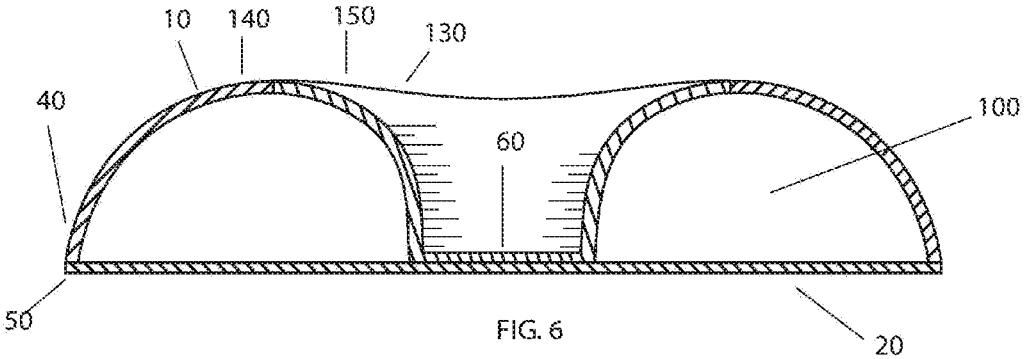
FIG. 6 is a cross-sectional side view of an exemplary cushion.
Figure 8:
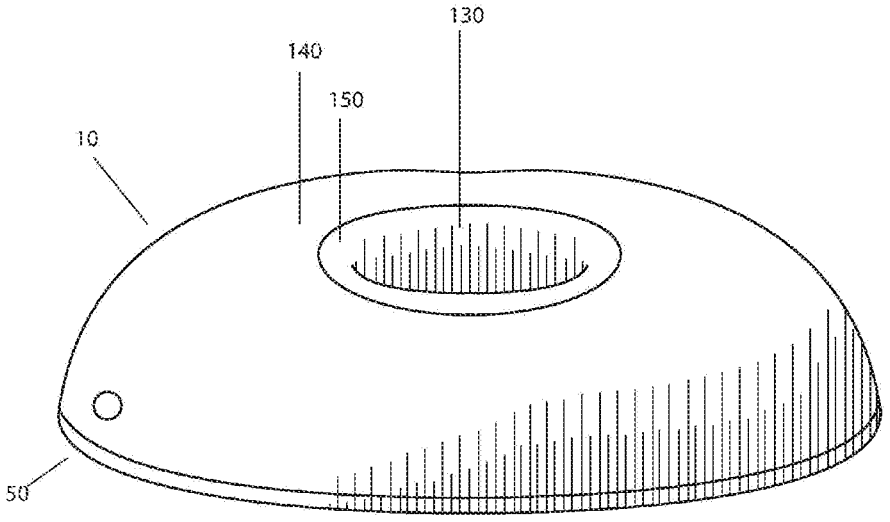
FIG. 8 is a perspective top view of an exemplary cushion.

In another embodiment, as seen in FIG. 6 and FIG. 8, the cushion comprises a base, a primary surface 10, and an indent region 13. In this embodiment, the primary surface 10 has an inner periphery 140 resulting from a hole in the center. The indent region 130 comprises center 60 as well as an outer periphery 150. The center 60, which is the result of a downward slope of the indent region 130 from the outer periphery 150, is fixed to the center of the base 70. The outer periphery 150 of the indent region 130 is attached to the inner periphery 140 of the primary surface 10. The attachment means may be any of those mentioned above. The base can be either exposed to the eye from a side view, as in FIG. 8, or concealed by a lip, as in FIG. 7.

In one or more embodiments, as seen in FIGS. 2, 5, 7, and 8, the cushion comprises an inlet 160. This inlet may be equipped with an inflation means, such as a push/pull cap. Inflating the cushion may be done with the mouth, or a manual or electric inflater, such as a hand pump. In another embodiment, the cushion may be made in such a way that inflation only occurs once, during the manufacturing process, and no further inflation is necessary. In this embodiment, the inlet may be permanently sealed after inflation. In FIG. 5, the inlet comprises a hole in the base 20, providing access to the above described inflation means, which is situated on the flush region of the primary surface. In FIG. 8, the inlet is situated on the primary surface.

Figure 9:
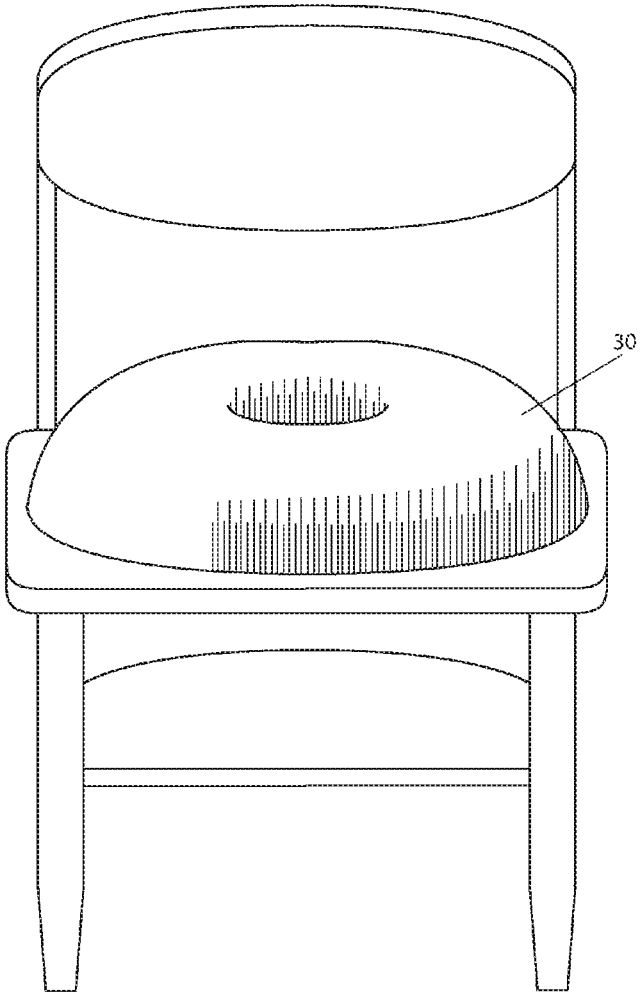
FIG. 9 is a top view of an exemplary cushion.
Figure 10:
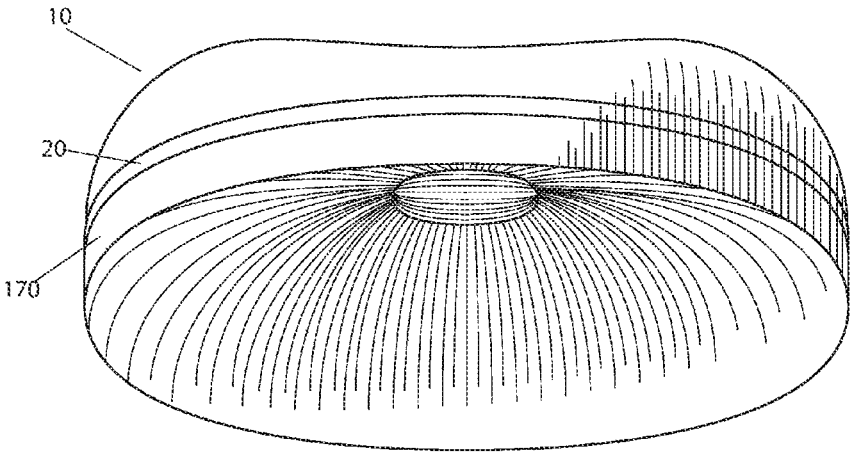
FIG. 10 is a perspective bottom view of an exemplary cushion.

In one embodiment, as seen in FIG. 9, the cushion 30 can be placed upon a chair or other piece of furniture. In one embodiment, as seen in FIG. 10, the base 20 comprises an adapting region 170. The purpose of the adapting region is to secure the cushion to a secondary surface, such as a stool, chair, couch, or any other piece of furniture meant for sitting. The adapting region may also be suitable to secure the cushion to areas traditionally not meant for sitting, such as the ground, or even a large rock.

In another embodiment, the surface of the adapting region can be textured or made of a high friction material, so that the adapting surface will not easily slide against the secondary surface, thereby further securing the adapting region to the secondary surface in a predetermined position.

In one embodiment, the adapting region may be made of firm material, and shaped to sit substantially flush upon a pre-selected secondary surface. In this embodiment, the adapting region may be made of the same material as the base, and may even be integrated into the base as a single piece.

In another embodiment, the adapting region may be made of elastic material, such that it conforms to one or more different secondary surfaces. The degree of elasticity should be the result of balancing the ability to securely attach the cushion to a diversity of surfaces, and ensuring that the attachment to a given surface is a strong one. If the adapting region is too elastic, then when a user sits upon the cushion, deformation will occur in the adapting region instead of the primary surface, and not only will the advantages of the primary surface be negated, but the adapting region will not secure the cushion to the secondary surface. Therefore, the adapting region should be less elastic than the primary surface. Deformation in the primary surface is also the result of the material density in the space between the base and the primary surface, and this should be taken into account to determine the best elasticity of the adapting region.

In one embodiment, the adapting region is shaped to fit a class of secondary surfaces, such as chairs with armrests. In this embodiment, the adapting region is partially formed to sit substantially flush against a class of secondary surfaces, rather than a particular secondary surface, and thereby it affords a compromise between a secure attachment and an attachment to a diversity of secondary surfaces.

In one embodiment, the base is attached to a leg structure. The leg structure may comprise one or more legs, and may also comprise one or more connections among those legs. The purpose of the leg structure is to support a seat and the weight of a person who sits upon that seat. Also, the leg structure must be made so that the seat is elevated a minimum distance from the ground. In some embodiments, the leg structure height may be modifiable.

The invention claimed is:

1. A cushion comprising a base, a primary surface, and an adapting region;

the base made of hard plastic, the base comprising a periphery, a flat center, and an area between the flat center and the periphery, the area between the flat center and the periphery surrounding the flat center by three hundred and sixty degrees, and the periphery surrounding the area between the flat center and the periphery by three hundred and sixty degrees;

the primary surface made of material more elastic than the base, the primary surface comprising a lip, a concave center, a convex end portion, a periphery, and an area between the concave center and the periphery, the area between the concave center and the periphery surrounding the concave center by three hundred and sixty degrees, the convex end portion surrounding the concave center by three hundred and sixty degrees, the periphery surrounding the convex end portion by three hundred and sixty degrees, the concave center of the primary surface directly attached to the flat center of the base, the periphery of the primary surface attached to the periphery of the base, the area between the concave center of the primary surface and the periphery of the primary surface not attached to the base; and the adapting region made of material less elastic than the primary surface and more elastic than the base, the adapting region comprising a contour, the adapting region being in a flush contact with the base, the flush contact being on a side of the base opposite the primary surface, the contour of the adapting region configured to change shape to conform to a seating surface of a chair, and the lip concealing the base when the cushion is placed on the seating surface of the chair.

2. The cushion in claim 1, the adapting region having a high friction texture, the high friction texture sufficiently rugged to prevent slipping between the adapting region and the seating surface of the chair.

3. The cushion in claim 1, wherein the cushion is filled with a gas.

4. The cushion in claim 1, wherein the cushion is filled with a liquid.

5. The cushion in claim 1, further comprising an inlet.

6. The cushion in claim 1, the base comprising a top face, the primary surface comprising a flush region, the flush region attached to the periphery of the primary surface and the concave center of the primary surface, the flush region not attached to the area between the concave center and the periphery, and a side of the flush region fully flush against the top face of the base.

7. A cushion comprising a base, a primary surface, and a leg structure;

the base made of material that substantially resists deformation, the base comprising a periphery, a top face, and a flat center, the periphery surrounding the flat center by three hundred and sixty degrees, the base attached to the leg structure, the leg structure comprising one or more legs for supporting the weight of the cushion; and the primary surface made of elastic material, comprises a concave center, a convex end portion, a periphery, an area between the concave center and the periphery, and a flush region, the convex end portion surrounding the concave center by three hundred and sixty degrees, the periphery surrounding the convex end portion by three hundred and sixty degrees, the area between the concave center and the periphery surrounding the concave center by three hundred and sixty degrees, the concave center of the primary surface attached to the flat center of the base, the periphery of the primary surface attached to the periphery of the base, the area between the concave center and the periphery of the primary surface not attached to the base, the flush region flush against the top face of the base, the flush region attached to the periphery of the primary surface, the flush region attached to the concave center of the primary surface, the flush region not attached to the area between the concave center and the periphery of the primary surface.

8. The cushion in claim 7, wherein the cushion is filled with a gas.

9. The cushion in claim 7, wherein the cushion is filled with a liquid.

10. The cushion in claim 7, wherein the cushion further comprises an inlet, and the inlet extends through the flush region and the base.

* * * * *